US011247486B1

(12) United States Patent
Herfindahl et al.

(10) Patent No.: US 11,247,486 B1
(45) Date of Patent: Feb. 15, 2022

(54) TAG PRINTER APPARATUS

(71) Applicant: CMSI Technologies, Maple Grove, MN (US)

(72) Inventors: Robert Herfindahl, Plymouth, MN (US); Mathew M. Benner, Elk River, MN (US); Eric L. Sorensen, Champlin, MN (US); Lamar Sorensen, Hanover, MN (US)

(73) Assignee: CMSI Technologies, Maple Grove, MN (US)

( * ) Notice: Subject to any disclaimer, the term of this patent is extended or adjusted under 35 U.S.C. 154(b) by 266 days.

(21) Appl. No.: 16/392,236

(22) Filed: Apr. 23, 2019

(51) Int. Cl.

| | |
|---|---|
| ***B41J 3/407*** | (2006.01) |
| ***B41J 15/04*** | (2006.01) |
| ***B41J 11/00*** | (2006.01) |
| ***B41J 15/16*** | (2006.01) |

(52) U.S. Cl.
CPC ..... *B41J 3/4075* (2013.01); *B41J 11/0005* (2013.01); *B41J 15/042* (2013.01); *B41J 15/046* (2013.01); *B41J 15/16* (2013.01)

(58) Field of Classification Search
CPC .... B41J 3/4075; B41J 11/0005; B41J 15/042; B41J 15/046; B41J 15/16
See application file for complete search history.

(56) References Cited

U.S. PATENT DOCUMENTS 3,908,544 A * 9/1975 Seidl ..... B65C 11/0289 101/292
4,702,468 A * 10/1987 Pollich ..... B65H 29/247 271/195
5,188,469 A * 2/1993 Nagao ..... B41J 3/4075 156/387
5,904,108 A * 5/1999 Tanaka ..... D05B 19/105 112/102.5
5,983,523 A * 11/1999 Ijas ..... D21F 5/08 34/115
6,038,789 A * 3/2000 Kaihovirta ..... D21F 5/00 34/117
6,490,821 B1 * 12/2002 Lacek ..... G09F 3/14 24/16 PB
9,358,819 B1 * 6/2016 Ranganathan ..... B41J 29/13
10,052,868 B1 * 8/2018 Tunmore ..... B41J 2/02
2005/0121146 A1 * 6/2005 Leonard, Jr. ..... B41J 3/4075 156/350

(Continued)

FOREIGN PATENT DOCUMENTS

JP 60164943 A * 8/1985

*Primary Examiner* — David H Banh
(74) *Attorney, Agent, or Firm* — Vidas, Arrett & Steinkraus PA; Richard A. Arrett; Edwin E. Voigt, II

(57) ABSTRACT

A tag printer apparatus for printing, severing and feeding non-curled labels to sewing machines. The tag printer apparatus includes a base; a control assembly including a central processing unit mounted to the base and adapted to be energized by a power source, and also including a monitor in communication with the central processing unit; a dispensing assembly mounted upon the base for dispensing print material; a support assembly mounted upon the base and including a support member; a printer assembly slidably mounted upon the support member and in operable communication with the central processing unit; and a tag feeder assembly connected to the support member and in communication with the central processing unit.

24 Claims, 4 Drawing Sheets

(56) References Cited

U.S. PATENT DOCUMENTS

2005/0126701 A1* 6/2005 Hodsdon ..... G09F 3/207
156/289
2005/0252968 A1* 11/2005 Tsujimura ..... G06K 7/10336
235/439
2006/0120792 A1* 6/2006 Yuyama ..... B41J 3/407
400/679
2007/0023516 A1* 2/2007 Chapman ..... G06K 17/00
235/432
2008/0038008 A1* 2/2008 Fujita ..... G03G 21/206
399/92
2008/0308172 A1* 12/2008 Terashima ..... D03D 15/54
139/420 R
2011/0061802 A1* 3/2011 Raming ..... G09F 3/10
156/256
2011/0259530 A1* 10/2011 Brook ..... E04H 4/084
160/120
2012/0164256 A1* 6/2012 Swanson ..... B29C 64/209
425/162
2012/0308289 A1* 12/2012 Kosuge ..... B41J 11/009
400/621
2013/0211864 A1* 8/2013 Sanderson ..... G06Q 10/02
705/5
2014/0202295 A1* 7/2014 Carson ..... B32B 38/0004
83/23
2016/0350625 A1* 12/2016 Liguori ..... G06K 15/022

* cited by examiner

TAG PRINTER APPARATUS

CROSS-REFERENCE TO RELATED APPLICATIONS

This application is related to the co-pending application entitled "A METHOD OF PRINTING A TAG AND ATTACHING THE TAG TO A BAG", filed on Apr. 23, 2019 under application Ser. No. 17/372,034, the entire contents of which is hereby incorporated by reference.

STATEMENT REGARDING FEDERALLY SPONSORED RESEARCH

Not Applicable

FIELD OF THE INVENTION

The present invention relates to printers and more particularly pertains to a new tag printer apparatus for printing, and dispensing non-curled labels and tags.

DESCRIPTION OF THE PRIOR ART

The use of printers is known in the prior art. More specifically, printers heretofore devised and utilized are known to consist basically of familiar, expected and obvious structural configurations, notwithstanding the myriad of designs encompassed by the crowded prior art which have been developed for the fulfillment of countless objectives and requirements.

The prior art includes printers which print individual labels or tags which are not directly fed to a sewing machine. While these devices fulfill their respective, particular objectives and requirements, the aforementioned patents do not disclose a new tag printer apparatus.

SUMMARY OF THE INVENTION

The general purpose of the present invention, which will be described subsequently in greater detail, is to provide a new tag printer apparatus which has many of the advantages of the printers mentioned heretofore and many novel features that result in a new tag printer apparatus which is not anticipated, rendered obvious, suggested, or even implied by any of the prior art printers, either alone or in any combination thereof. The present invention includes a base; a control assembly including a central processing unit mounted to the base and adapted to be energized by a power source, and also including a monitor in communication with the central processing unit; a dispensing assembly mounted upon the base for dispensing print material; a support assembly mounted upon the base and including a support member; a printer assembly slidably mounted upon the support member and in operable communication with the central processing unit; and a tag feeder assembly connected to the support member and in communication with the central processing unit. None of the prior art includes the combination of the elements of the present invention.

There has thus been outlined, rather broadly, the more important features of the tag printer apparatus in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new tag printer apparatus which has many of the advantages of the printers mentioned heretofore and many novel features that result in a new tag printer apparatus which is not anticipated, rendered obvious, suggested, or even implied by any of the prior art printers, either alone or in any combination thereof.

Still another object of the present invention is to provide a new tag printer apparatus for printing, severing and feeding non-curled labels and tags to sewing machines.

Still yet another object of the present invention is to provide a new tag printer apparatus that continuously or intermittently feeds printed tags to a sewing machine which attaches the labels and tags to the packaging.

Even still another object of the present invention is to provide a new tag printer apparatus that prevents the tags from being curled and can be adjusted to print on any size tag.

These together with other objects of the invention, along with the various features of novelty which characterize the invention, are pointed out with particularity in the claims annexed to and forming a part of this disclosure. For a better understanding of the invention, its operating advantages and the specific objects attained by is uses, reference should be made to the accompanying drawings and descriptive matter in which there are illustrated preferred embodiments of the invention.

BRIEF DESCRIPTION OF THE DRAWING

The invention will be better understood and objects other than those set forth above will become apparent when consideration is given to the following detailed description thereof. Such description makes reference to the annexed drawing wherein.

DETAILED DESCRIPTION OF THE INVENTION

Figure 1:
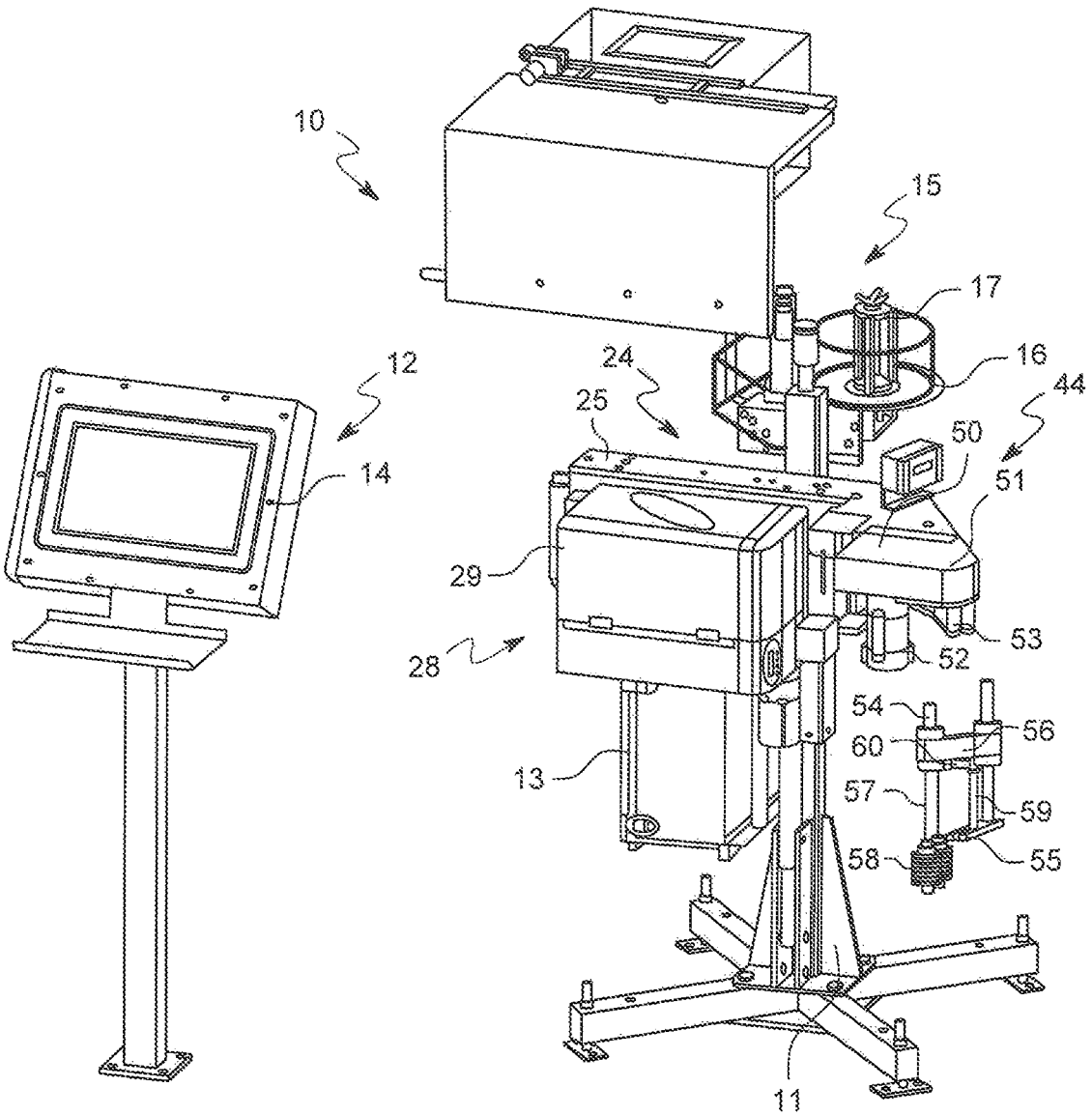
FIG. 1 is a perspective view of a new tag printer apparatus according to the present invention.
Figure 2:
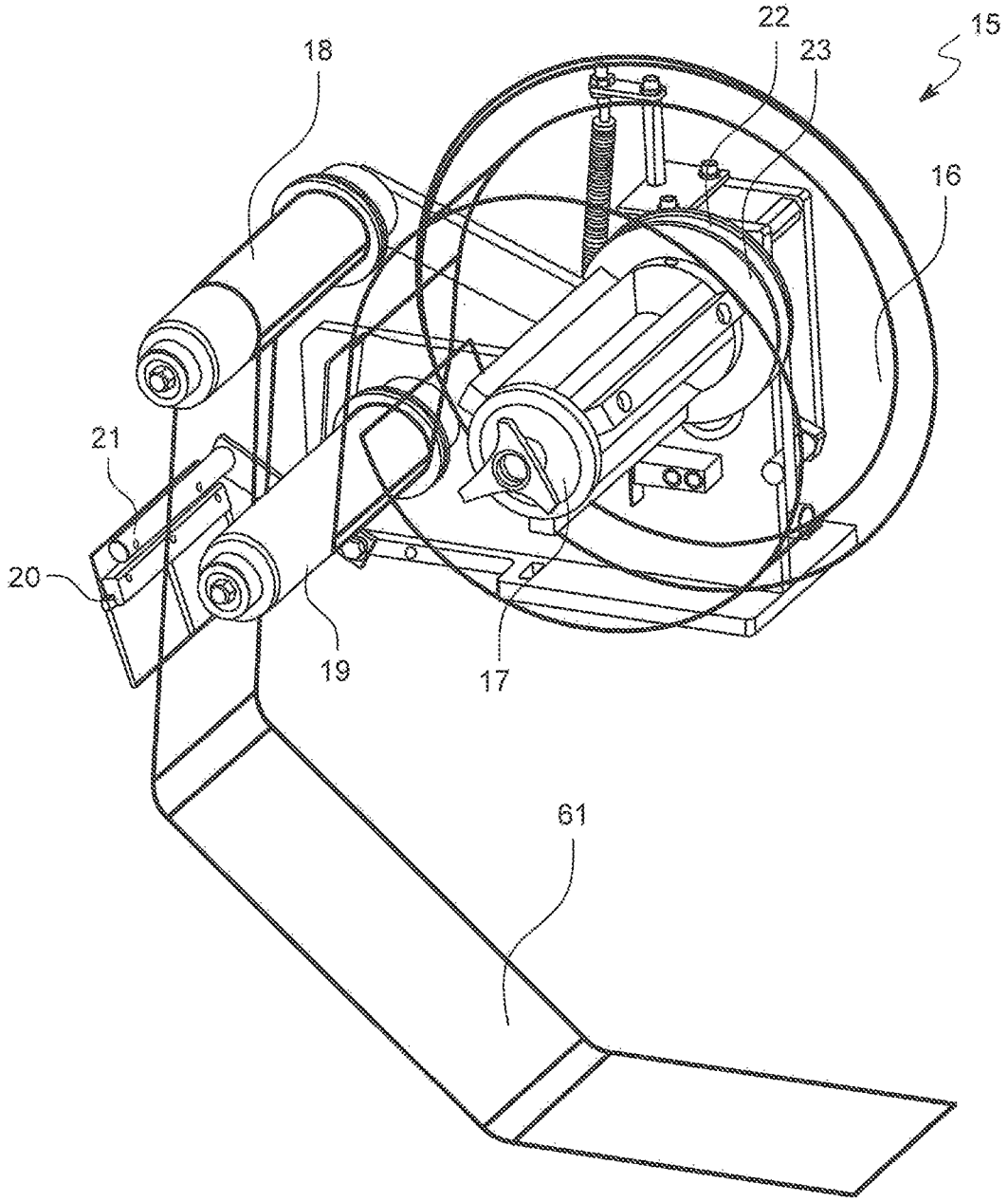
FIG. 2 is a top perspective view of the dispenser assembly of the present invention.
Figure 3:
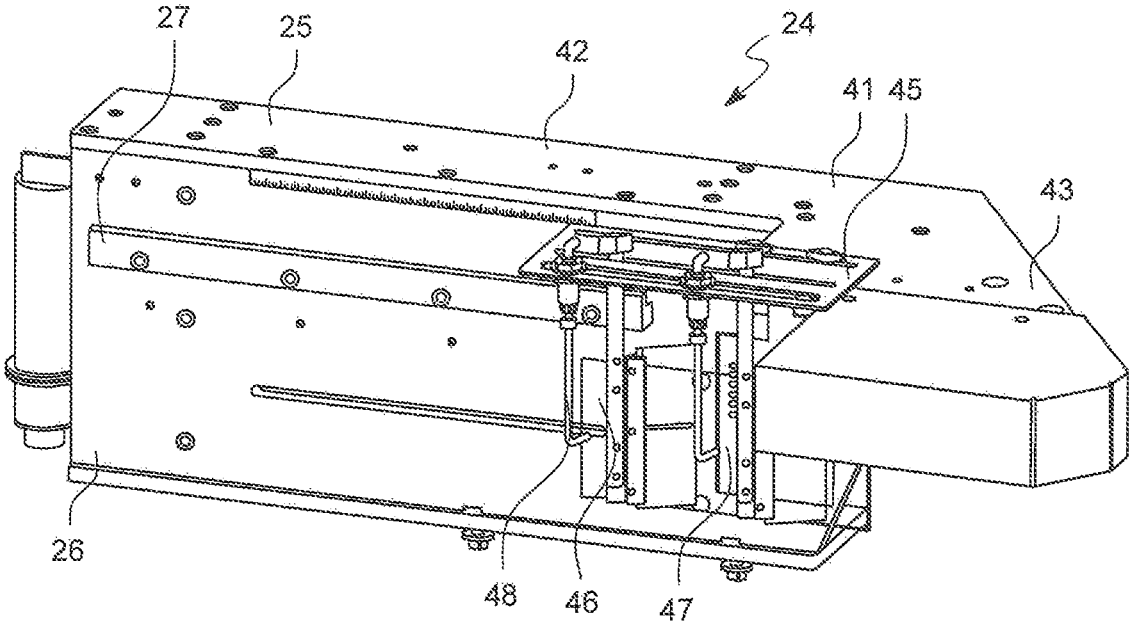
FIG. 3 is a perspective view of the support assembly of the present invention.
Figure 4:
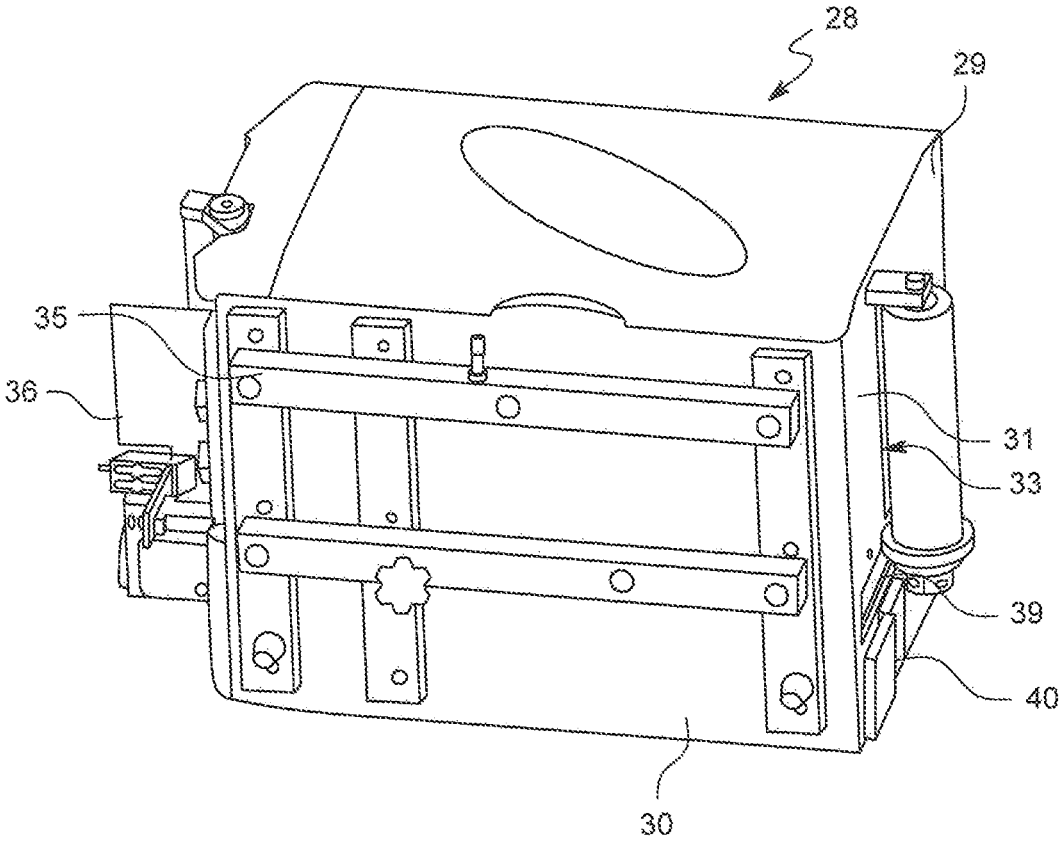
FIG. 4 is a perspective view of the printer unit of the present invention.
Figure 5:
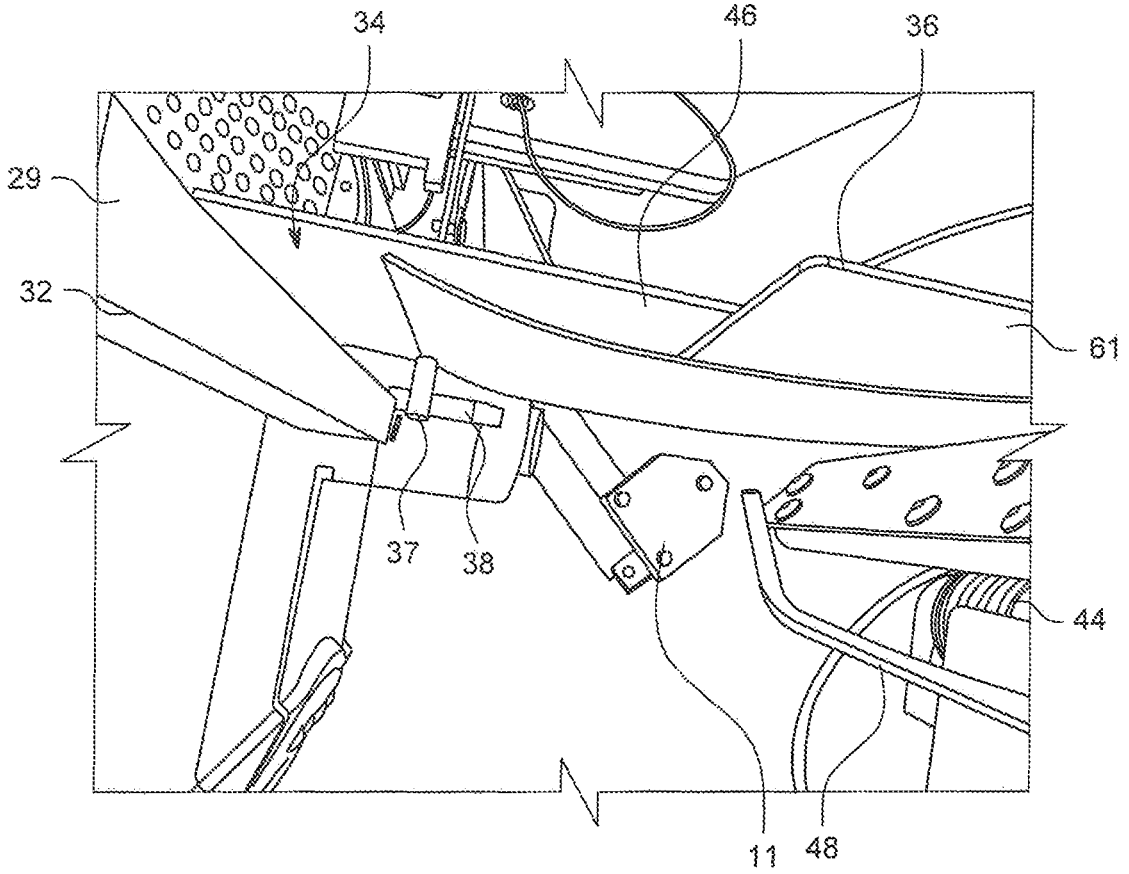
FIG. 5 is a partial top plan view of the printer unit and the support assembly of the present invention.

With reference now to the drawing, and in particular to FIGS. 1 through 5 thereof, a new tag printer apparatus embodying the principles and concepts of the present invention will be described.

As best illustrated in FIGS. 1 through 5, the tag printer apparatus generally comprises a base 11; a control assembly 12 including a central processing unit 13 conventionally mounted to the base 11 and adapted to be energized by a power source, and also including a monitor 14 in conventional communication with the central processing unit 13; a dispensing assembly 15 conventionally mounted upon the base 11 for dispensing print material 61; a support assembly 24 conventionally mounted upon the base 11 and including a support member 25; a printer assembly 28 conventionally mounted upon the support member 25 and in operable communication with the central processing unit 13; and a tag feeder assembly 44 conventionally connected to the support member 25 and in conventional communication with the central processing unit 13.

The dispensing assembly 15 includes a platform 16 rotatably and conventionally mounted upon the base 11 and also includes a spindle 17 conventionally disposed vertically upon the platform 16 for rotation therewith and for supporting a replaceable roll of the print material 61. The dispensing assembly 15 further includes guide rollers 18, 19 spaced apart and conventionally connected to the base 11 and extending beyond a perimeter of the platform 16 for carrying the print material 61 being dispensed, and also includes a first sensor 20 conventionally mounted to the base 11 and disposed between the guide rollers 18, 19 and in conventional communication with the central processing unit and adapted to correct disorientation of the print material 61 being dispensed from the spindle 17. The dispensing assembly 15 also includes a pulley 22 conventionally connected to the platform 16 and a tension member 23 carried by the pulley 22 and further includes a first brush 21 conventionally connected to the base 11 to keep the replaceable roll of print material 61 taut.

The support member 25 includes a side wall 26 vertically disposed and conventionally mounted to the base 11. The support assembly 24 also includes a first rail 27 conventionally attached to the side wall 26 and extending horizontally and lengthwise thereof.

The printer assembly 28 includes a printer unit 29 having a front end 31, a rear end 32 and a side wall 30 and being in conventional operable communication with the central processing unit 13 and adapted to receive, print and sever the print material 61 into tags and dispensed from the printer unit 29. The printer unit 29 also includes an entry port 33 through the front end 31 and an exit port 34 through the rear end 32. The printer assembly 28 also includes a second rail 35 conventionally attached to the side wall 30 and extending from near the rear end 32 to the near the front end 31 of the printer unit 29. The second rail 35 is conventionally mounted to the first rail 27. The printer assembly 28 further includes a first guide plate 36 conventionally attached to and extending outwardly from the rear end 32 and adjacent to the exit port 34 of the printer unit 29. The printer assembly 28 also includes a guide pin 37 conventionally attached at the rear end 32 of the printer unit 29 perpendicular to and below the exit port 34 to support a tag 61 being dispensed from the printer unit 29. The printer assembly 28 further includes a second sensor 38 conventionally attached at the exit port 34 of the printer unit 29 and in conventional communication with the central processing unit and adapted to detect the tag 61 being dispensed from the printer unit 29. The printer assembly 28 includes a fan 39 conventionally mounted to the front end 31 of the printer unit 29 and also includes a filter 40 conventionally mounted over the fan 39 to prevent outside dust particles from entering the printer unit 29 and to exhaust inside dust particles from inside the printer unit 29.

The support member 25 also includes a top wall 41 conventionally mounted upon the side wall 26 and having a main portion 42 and an end portion 43 angled from the main portion 42. The tag feeder assembly 44 includes a bracket 45 conventionally attached to the end portion 43 of the top wall 41 with a second guide plate 46 adjustably and conventionally depending from the bracket 45 and with a second brush 47 also adjustably and conventionally depending from the bracket 45 adjacent to the second guide plate 46 to hold and feed the tag 61 to the tag feeder assembly 44. The second guide plate 46 adjustably overlaps the first guide plate 36 and is movable horizontally relative to the first guide plate 36 depending upon the width of the tag 61 being dispensed from the exit port 34 of the printer unit 29. The tag feeder assembly 44 includes a compressed air line 48 adjustably and conventionally depending from the bracket 45 and disposed adjacent to the exit port 34 of the printer unit 29 and in operable and conventional communication with the central processing unit 13 and adapted to be connected to an air compressor for transmitting compressed air through the air compressed line 48 and onto the tags 61 as they are being moved along the first and second guide plates 36, 46 to prevent the tags 61 from being curled and skewed.

The tag feeder assembly 44 also includes a feeder arrangement 50 conventionally appended to the end portion 43 of the support member 25 and including a power source 52 and feeder rollers 53 conventionally connected to the power source 52 and adapted for feeding the tags 61 from the printer unit 29 to a sewing machine for sewing the tags to packaging materials. The tag feeder assembly 44 further includes a feeder guide 54 in conventional communication at an end 51 of the feeder arrangement 50 and in alignment with the feeder rollers 53. The feeder guide 54 includes a mounting plate 55 in conventional communication at the end 51 of the feeder arrangement 50, a bracket member 56 conventionally mounted to the mounting plate 55, a roller support member 57 conventionally connected to the bracket member 56, guide rollers 58 conventionally mounted to the roller support member 57, a biased support member 59 conventionally mounted upon the mounting plate 55 and a spring 60 conventionally connected to the biased support member 59 and to the roller support member 57 for biasing the guide rollers 58 which are spaced from and aligned with the feeder rollers 53 and adapted to further guide the tags 61 to the sewing machine.

In use, a replaceable roll of print material 61 is fed through the printer unit 29 whereupon the print material 61 is printed and severed into tags 61. The tags 61 are prevented from curling and jamming as they are fed to the tag feeder assembly 44. The tags are staged for dispensing to the tag feeder assembly on demand. In an embodiment the tags 61 are fed to a sewing machine whereupon the tags 61 are conventionally attached to packaging materials. It should be understood that other attachment methods for attaching the tags could also be utilized. The compressed air line 48 blows compressed air onto the tags 61 as they are being fed from the printer unit 29 to the tag feeder assembly 44. Compressed air is blown onto the tags 61 as they are being fed along the first and second guide plates 36, 46 to the dispensing and tag feeder assembly 44 to prevent the tags 61 from curling and jamming.

An important feature of the invention is that pin 37 supports tag 61 as it is printed and moved out of the printer assembly 28 by the guide rollers 18 and 19. Pin 37, in combination with compressed air line 48 prevent the curling and jamming as the tag 61 is fed to the tag feeder assembly. Again, the tags can be printed and staged for feeding to the dispensing and tag feeder assembly 44 on demand.

As to a further discussion of the manner of usage and operation of the present invention, the same should be apparent from the above description. Accordingly, no further discussion relating to the manner of usage and operation will be provided. It should also be understood that by tag or label, the application is referring to any type of printed material, whether with an adhesive backing or not, that can be attached to something like a bag.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the tag printer apparatus Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A tag printer apparatus comprising:

a base;

a control assembly including a central processing unit mounted to the base and adapted to be energized by a power source, and also including a monitor in communication with the central processing unit;

a dispensing assembly mounted upon the base for dispensing print material;

a support assembly mounted upon the base and including a support member;

a printer assembly mounted upon the support member and in operable communication with the central processing unit; and a tag feeder assembly connected to the support member and in communication with the central processing unit, wherein the tag feeder assembly includes a compressed air line in operable communication with the central processing unit and adapted to be connected to an air compressor for transmitting compressed air through the air compressed line and onto the tags as they are being fed to the tag feeder assembly to prevent the tags from being curled and skewed.

2. The tag printer apparatus as described in claim 1, wherein the dispensing assembly includes a platform rotatably mounted upon the base.

3. The tag printer apparatus as described in claim 2, also including a spindle disposed vertically upon the platform for rotation therewith and for supporting a replaceable roll of the print material.

4. The tag printer apparatus as described in claim 2, wherein the dispensing assembly further includes guide rollers spaced apart and attached to the base and extending beyond a perimeter of the platform for carrying the print material being dispensed.

5. The tag printer apparatus as described in claim 4, also including a first sensor mounted to the base and disposed between the guide rollers and in communication with the central processing unit and adapted to correct disorientation of the print material being dispensed from the spindle.

6. The tag printer apparatus as described in claim 5, wherein the dispensing assembly also includes a pulley connected to the platform and a tension member carried by the pulley and further includes a first brush connected to the base to keep the replaceable roll of print material taut.

7. The tag printer apparatus as described in claim 2, wherein the support member includes a side wall vertically disposed and mounted to the base, wherein the support assembly also includes a first rail attached to the side wall and extending horizontally and lengthwise thereof.

8. The tag printer apparatus as described in claim 7, wherein the printer assembly includes a printer unit having a front end, a rear end and a printer assembly side wall and being in operable communication with the central processing unit and adapted to receive, print and sever the print material into tags and dispensed from the printer unit.

9. The tag printer apparatus as described in claim 8, wherein the printer unit also includes an entry port through the front end and an exit port through the rear end.

10. The tag printer apparatus as described in claim 8, wherein the printer assembly also includes a second rail attached to the printer assembly side wall and extending from near the rear end to the near the front end of the printer unit, wherein the second rail is mounted to the first rail.

11. The tag printer apparatus as described in claim 10, wherein the printer assembly further includes a first guide plate extending outwardly from the rear end and adjacent to the exit port of the printer unit.

12. The tag printer apparatus as described in claim 11, wherein the printer assembly also include a guide pin disposed at the rear end of the printer unit below the exit port to support a tag being dispensed from the printer unit, wherein the printer assembly further includes a second sensor disposed at the exit port of the printer unit and in communication with the central processing unit and adapted to detect the tag being dispensed from the printer unit.

13. The tag printer apparatus as described in claim 8, wherein the printer assembly includes a fan mounted to the front end of the printer unit and also includes a filter mounted over the fan to prevent outside dust particles from entering the printer unit and to exhaust inside dust particles from inside the printer unit.

14. The tag printer apparatus as described in claim 11, wherein the support member also includes a top wall mounted upon the side wall and having a main portion and an end portion angled from the main portion.

15. The tag printer apparatus as described in claim 14, wherein the tag feeder assembly includes a bracket attached to the end portion of the top wall with a second guide plate adjustably depending from the bracket and with a second brush also adjustably depending from the bracket adjacent to the second guide plate to hold the tag to feed the tag to the tag feeder assembly; wherein the second guide plate adjustably overlaps the first guide plate and is movable horizontally relative to the first guide plate depending upon the width of the tag being dispensed from the exit end of the printer unit.

16. The tag printer apparatus as described in claim 15, wherein the compressed air line is adjustably depending from the bracket and disposed adjacent to the exit port of the printer and in operable communication with the central processing unit and adapted to be connected to an air compressor for transmitting compressed air through the air compressed line and onto the tags as they are being moved along the first and second guide plates to prevent the tags from being curled and skewed.

17. The tag printer apparatus as described in claim 15, wherein the tag feeder assembly also includes a feeder arrangement appended to the end portion of the support member and including a power source and feeder rollers connected to the power source and adapted for feeding the tags from the printer unit to a sewing machine for sewing the tags to packaging materials.

18. The tag printer apparatus as described in claim 17, wherein the tag feeder assembly further includes a feeder guide in communication at an end of the feeder arrangement and in alignment with the feeder rollers.

19. The tag printer apparatus as described in claim 18, wherein the feeder guide includes a mounting plate in communication at the end of the feeder arrangement, a bracket member mounted to the mounting plate, a roller support member connected to the bracket member, guide rollers mounted to the roller support member, a biased support member mounted upon the mounting plate and a spring connected to the biased support member and to the roller support member for biasing the guide rollers which are spaced from and aligned with the feeder rollers and adapted to further guide the tags to the sewing machine.

20. The tag printer apparatus of claim 1 further wherein the on demand tag feeder assembly is an on demand tag feeder assembly which is operatively connected to a bag sensing device permitting the printing of a second tag as the fed tag is dispensed on demand.

21. A method of using a tag printer apparatus comprising the steps of:

providing a base, a central processing unit, a support assembly mounted to the base, a printer unit mounted upon the support assembly, and tag feeder assembly mounted to the support assembly;

feeding a replaceable roll of print material through the printer unit whereupon the print material is printed and severed into tags;

preventing the tags from curling and jamming as they are fed to the tag feeder assembly by directing compressed air onto the tags as they are being fed from the printer unit to the tag feeder assembly; and feeding the tags to a sewing machine whereupon the tags are attached to packaging materials.

22. The method of using the tag printer apparatus as described in claim 21 further comprising blowing compressed air onto the tags as they are being fed along first and second guide members to the tag feeder assembly to prevent the tags from curling and jamming.

23. A tag printer apparatus comprising:

a printer assembly for printing a tag;

a support mechanism to support the tag as it is being printed and fed to a tag feeder assembly;

a device for preventing curling and jamming of the tag as it is fed to the tag feeder assembly, wherein the tag feeder assembly includes a compressed air line in operable communication with the central processing unit and adapted to be connected to an air compressor for transmitting compressed air through the air compressed line and onto the tags as they are being fed to the tag feeder assembly to prevent the tags from being curled and skewed.

24. The tag printer apparatus of claim 23 wherein the device for preventing curling and jamming is the compressed air line which blows compressed air onto the tag as it is being supported by the support mechanism and fed to the tag feeder assembly.

* * * * *